United States Patent [19]

Charette

[11] 4,234,987

[45] Nov. 25, 1980

[54] ADJUSTABLE WRENCH ADAPTED FOR USE AS A HAMMER

[76] Inventor: Joseph R. Charette, 229 College St., Sudbury, Ontario, Canada, P3C 4V3

[21] Appl. No.: 30,293

[22] Filed: Apr. 16, 1979

[51] Int. Cl.[3] ..... B25F 1/00; B25B 13/14

[52] U.S. Cl. ..... 7/139; 7/143

[58] Field of Search ..... 7/138, 139, 143; 81/130 R, 165

[56] References Cited

U.S. PATENT DOCUMENTS

| | | | |
|---|---|---|---|
| D. 156,732 | 1/1950 | Hoeflicker | 7/143 |
| 1,133,236 | 3/1915 | Peterson | 81/165 |
| 2,528,128 | 10/1950 | Forster | 7/143 |

FOREIGN PATENT DOCUMENTS

| | | | |
|---|---|---|---|
| 158944 | 5/1957 | Sweden | 81/165 |
| 399376 | 10/1933 | United Kingdom | 7/143 |

*Primary Examiner*—Othell M. Simpson
*Assistant Examiner*—Roscoe V. Parker
*Attorney, Agent, or Firm*—Fetherstonhaugh & Co.

[57] ABSTRACT

The present invention provides for the adaptation of an adjustable wrench so that it may be used as a hammer and as a wrench without the use as a hammer causing undue damage to the mechanism required to enable the device to operate as a wrench. A hammer head is located on the crown portion of the wrench head. A passage opens inwardly of the hammer head through the side faces thereof to communicate with the adjustment screw passage to permit debris which accumulates at one end of the adjustment screw passage to be flushed therefrom.

1 Claim, 2 Drawing Figures

ADJUSTABLE WRENCH ADAPTED FOR USE AS A HAMMER

FIELD OF INVENTION

Figure 1:
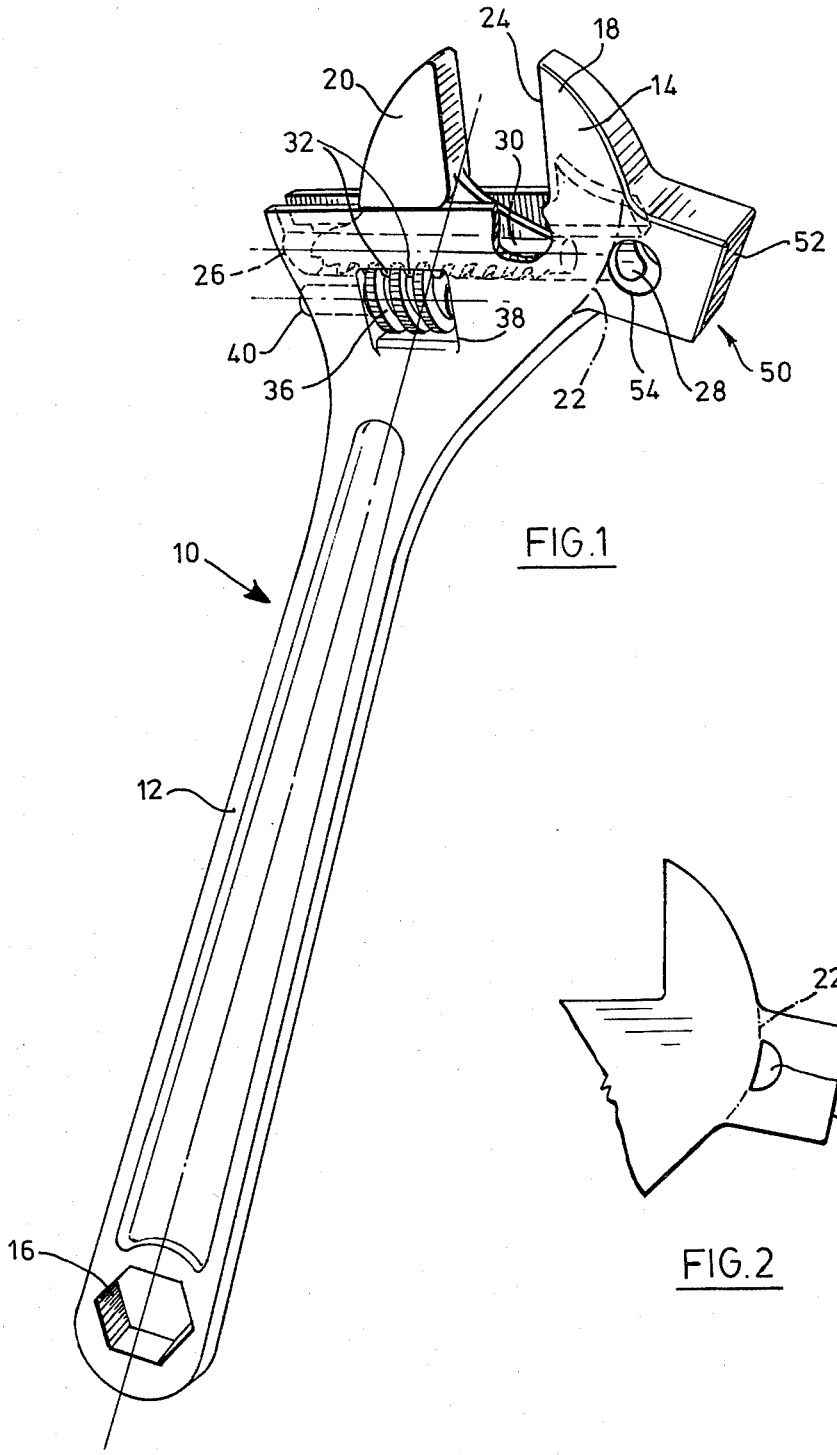

This invention relates to the adaptation of an adjustable wrench to permit it to be used as a hammer.

PRIOR ART

An adjustable wrench is the principal tool employed by miners and is used for a wide variety of purposes in making adjustments in mining machinery. The nature of the mining industry is such that it is not practical for the individual miner to carry with him a full set of tools of a type which might normally be used by a mechanic in a machine shop operation. Consequently, there is a requirement for multi-purpose tools in the mining industry. For many years miners have used the head of an adjustable wrench as a hammer head. The effect of this use has been that the head is rendered inoperative much earlier than it would if the same wrench is used solely as an adjustable wrench. The structure of the head of an adjustable wrench is not well suited for use as a hammer head primarily because the screw adjustment passage which is formed in the head opens through the crown portion of the head which is most conveniently located for use as a hammer face. Thus, in using the wrench head as a hammer head the impact is applied to the weakest point on the head, namely, the area through which the adjustment screw passage opens. This area tends to become damaged to an extent which limits the usefulness of the adjustment mechanism.

In order to rigidify the wrench head before it is used as a hammer, the operator will frequently operate the clamping screw so as to position the adjustable jaw closely adjacent the fixed jaw. In so doing, the leg portion of the adjustable jaw may be caused to project through the open end of the screw adjustment passage in the area of the crown and as a result it may form the hammer face of the wrench. Thus, when the wrench is used as a hammer the hammer load is applied directly to the adjustable jaw and this can result in a rapid deterioration in the screw interface between the adjustment screw and the movable jaw.

For the above reasons, every effort has been made to discourage miners from using wrenches in this manner. However, the convenience of having a multi-purpose heavy tool readily available is such that miners tend to ignore the consequences of the abuse of the tool in favour of the convenience.

SUMMARY OF INVENTION

The present invention overcomes the difficulties of the prior art described above and provides for the adaptation of an adjustable wrench so that it may be used as a hammer, in addition to a wrench, without the use of a hammer causing undue damage to the mechanism required to enable the device to operate as a wrench.

According to one aspect of the present invention, there is provided in an adjustable wrench having an elongated wrench handle and an adjustable wrench head at one end of the wrench handle, the wrench head and wrench handle extending in a first plane, the wrench head having a fixed jaw and a movable jaw, the wrench head including a crown portion on an outer edge of the fixed jaw, an adjustment passage extending through the wrench head and opening at one end through the crown portion, the improvement of a hammer head on the crown portion projecting outwardly therefrom in said first plane, said hammer head having a hammer face at its outer end directed away from the direction of the longitudinal extent of the handle such that the hammer head and wrench handle may be employed as a hammer, said hammer head having side faces extending inwardly from the hammer face, a second passage opening inwardly of said hammer head through at least one side face thereof and communicating with said one end of said adjustment passage whereby debris accumulated at one end of said adjustment passage may be flushed therefrom through said second passage.

PREFERRED EMBODIMENT

Figure 2:
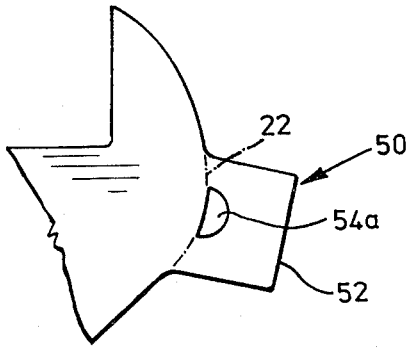

The invention will be more clearly understood after reference to the following detailed specification read in conjunction with the drawings, wherein FIG. 1 is a pictorial view of an adjustable wrench adapted for use as a hammer in accordance with one aspect of the present invention;

FIG. 2 is a side view of the head portion of an adjustable wrench constructed in accordance with a further embodiment of the present invention.

With reference to the drawings, the reference numeral 10 refers generally to an adjustable wrench constructed in accordance with an embodiment of the present invention. The wrench 10 includes a longitudinally elongated handle portion 12 and a wrench head portion 14 at one end of the handle. A hexagonal shaped passage 16 is located at the other end of the handle for use as a ring wrench.

The wrench head 14 has a fixed jaw 18 and a movable jaw 20 disposed opposite one another. The fixed jaw 18 has a crown portion 22 extending in an arc from the clamping face 24 thereof to the handle 12. An adjustment passage or slipway 26 is formed in the head 14 and extends through the head and has an open end 28 opening through the crown portion 22 of the wrench head. The movable jaw 20 has a leg portion 30 slidably mounted in the adjustment passage 26. The leg portion 30 has a rack face 32 formed thereon. An adjustment screw 36 is mounted in an adjustment screw passage 38 which opens through the thickness of the head of the wrench. The adjustment screw 36 is supported for rotation on a shaft 40, the opposite ends of which are mounted in the head on opposite sides of the adjustment screw passage 38. By rotatably driving the adjustment screw 36, the movable jaw 20 may be moved toward and away from the fixed jaw 24.

The structure described above with reference to FIG. 1 is that commonly available in adjustable wrenches of the type best suited for adaptation to incorporate a hammer head in accordance with the present invention.

The hammer head of the present invention is generally identified by the reference numeral 50. The hammer head 50 is located at the crown portion 22 and projects outwardly therefrom. The hammer head portion 50 may be formed as an integral part of the wrench head or it may be subsequently secured to the crown portion as by welding or the like. The hammer head 50 is formed with a hammer face 52 which is oriented so as to be conveniently located for use in association with the elongated handle to perform the functions of a hammer. The passage 54 opens through the hammer head 50 in the area of the crown of the wrench head and communicates with the slide passage 26. The passage 54 permits debris which tends to accumulate at the outer end 28 of the passage 26 to be removed therefrom as by flushing through the passage 54. The passage 54 also provides clearance which will permit a portion of the leg 32 to project a short distance beyond the outer end 28 of the passage 26 so as to permit the movable jaw 20 to move closely adjacent the fixed jaw 18.

From the foregoing it will be apparent that the tool of the present invention is capable of functioning as both an adjustable wrench and a hammer, the hammer head portion being specially adapted to permit the wrench to operate successfully as a wrench.

Various modifications of the tool of the present invention will be apparent to those skilled in the art. In one such modification, as illustrated in FIG. 2 of the drawings, the passage 54*a* is semi-circular in shape. This configuration is particularly suitable for use when the hammer head 50 is formed as a separate component and is subsequently welded to the crown portion 22. These and other modifications will be apparent to those skilled in the art.

I claim:

1. In an adjustable wrench having an elongated wrench handle and an adjustable wrench head at one end of the wrench handle, and the wrench head and wrench handle extending in opposite longitudinal directions in a first plane, and the wrench head having a fixed jaw and a movable jaw, and the wrench head including a crown portion on an outer edge of the fixed jaw and a movable jaw adjustment screw passage extending through the wrench head in a direction which is substantially transverse with respect to said longitudinal direction and opening at one end outwardly through the crown portion, the improvement comprising;

a hammer head fixed on the crown portion and projecting transversely outwardly therefrom in said first plane, said hammer head having a hammer face disposed to lie across said one end of said adjustment screw passage and to occupy a second plane which is normal to the first plane and which is in non-intersecting relationship with said wrench handle such that the hammer head and wrench handle may be employed as a hammer, said hammer head having opposed side faces extending inwardly from the hammer face and joining the crown portion, and the hammer head having a second passage extending through at least one side face thereof and communicating with said one end of said adjustment passage, whereby debris accumulated at said one end of said adjustment passage may be flushed therefrom through said second passage.

* * * * *